United States Patent [19]

Adkisson et al.

[11] 4,452,543

[45] Jun. 5, 1984

[54] HIGH SPEED PRINTER WITH MULTIPLE PAPER PATHS

[75] Inventors: James W. Adkisson, S. Merrit Is.; David W. Davis, Titusville; Paul A. Ishman, Melbourne Village, all of Fla.

[73] Assignee: Florida Data Corporation, Melbourne, Fla.

[21] Appl. No.: 339,272

[22] Filed: Jan. 15, 1982

[51] Int. Cl.[3] ..... B41J 11/00

[52] U.S. Cl. ..... 400/605; 400/625; 400/639.1; 271/9; 226/110

[58] Field of Search ..... 400/605, 624, 625, 639, 400/639.1, 639.2, 638; 271/9; 226/108–110

[56] References Cited

U.S. PATENT DOCUMENTS

| | | | |
|---|---|---|---|
| 1,900,102 | 3/1933 | Going | 400/638 |
| 1,916,371 | 7/1933 | Helmond | 400/639.2 |
| 3,625,333 | 12/1971 | Cortona et al. | 400/639.1 |
| 3,753,483 | 8/1973 | Lundquist et al. | 400/605 |
| 4,164,376 | 8/1979 | Yarp | 400/605 |
| 4,229,113 | 10/1980 | Anderson | 400/605 |
| 4,262,894 | 4/1981 | Marano | 271/4 |
| 4,341,480 | 7/1982 | Mailer | 400/625 |

FOREIGN PATENT DOCUMENTS

| | | | |
|---|---|---|---|
| 35178 | 9/1981 | European Pat. Off. | 400/639.1 |
| 2716396 | 10/1978 | Fed. Rep. of Germany | 400/605 |
| 2855253 | 7/1980 | Fed. Rep. of Germany | 400/624 |

OTHER PUBLICATIONS

Garrison et al., "Paper Feed Apparatus" IBM Technical Disclosure Bulletin, vol. 22, No. 4, pp. 1321–1322, 9/79.

Garrison et al., "Single Sheet Insertion" IBM Technical Disclosure Bulletin, vol. 23, No. 9, pp. 3965–3966, 2/81.

*Primary Examiner*—William Pieprz

*Attorney, Agent, or Firm*—Howard L. Rose

[57] ABSTRACT

A high speed printer has multiple paths to accommodate cut paper sheets, manually fed paper and continuous forms for supply to a cylindrical platen such that the printer can be utilized with various types and sizes of paper. The printer includes a bail mechanism operable to capture the cut paper sheets and the manually fed sheets and to be moved to a displaced position when the printer is used for continuous forms.

16 Claims, 7 Drawing Figures

HIGH SPEED PRINTER WITH MULTIPLE PAPER PATHS

BACKGROUND OF THE INVENTION

1. Field of the Invention

The present invention pertains to printers and, more particularly, to high speed printers having a paper feed path for manually fed or continuous roll papers, a paper feed path for cut paper sheets and a paper feed path for continuous forms.

2. Discussion of the Prior Art

High speed printers, such as those utilizing matrix printing techniques, have become extremely popular and are desirable for use in as many applications as possible. It is extremely desirable to incorporate high speed printers in office systems to satisfy the growing market demand for increased speed in correspondence quality and word processing output for rough draft and data processing requirements. To be acceptable for use in office systems, high speed printers are preferably of a small size to be supported on a desk or table top and preferably should be able to print on various types of paper including cut paper sheets, continuous roll paper, individual sheets of paper of varying sizes and continuous forms. Prior art printers cannot accept the various types of paper utilized in present day office systems and, thus, have the disadvantages, when incorporated into an office system, of limiting the type of printout available for office work.

Prior art apparatus have had the capability of supplying two feeds to a typewriter or printer, as exemplified by U.S. Pat. No. 3,753,483 to Lundquist et al, which utilizes a dual feed apparatus for a typewriter such that paper can be fed downwardly to the rear of a platen cylinder, as is conventional, or upwardly from below the platen cylinder by a tractor drive, and as exemplified by U.S. Pat. No. 4,204,668 to Yanagawa, which provides apparatus for feeding paper into a machine either manually or with the use of a cassette feeder. Prior art apparatus, accordingly, has the disadvantage of not having sufficient versatility to be acceptable in office systems since the type of printout is limited.

SUMMARY OF THE INVENTION

Accordingly, it is a primary object of the present invention to overcome the above mentioned disadvantages of the prior art by establishing paper paths in a high speed printer for receiving cut paper sheets, cassette held sheets and irregular size paper, or continuous forms.

Another object of the present invention is to compactly construct a high speed printer having multiple paper paths for support on a desk or table top.

The present invention has a further object in that a bail is movable relative to a rotatable cylindrical platen to engage cut paper sheets or irregular size paper and is movable to a position so as not to engage continuous forms such as tractor fed fan fold paper.

Another object of the present invention is to utilize a cylindrical platen in a high speed printer in combination with a movable bail to permit cut paper sheets to be delivered via a picker roll around the platen from a side position, to permit continuous roll or irregular size paper to be delivered to the platen from a top position and to permit continuous forms to be delivered to the platen from a bottom position with the bail moved to a position so as not to interfere with the continuous forms.

Some of the advantages of the present invention over the prior art are that the printer can accept paper of all conventional types and sizes without requiring manual modification of the paper feed mechanism or the printer except for head gap adjustment, and the printer and paper feed mechanisms are simple in structure and operate to smoothly deliver paper around the platen to the printing station.

The present invention is generally characterized in a printer with multiple paper paths including (a) a housing having an opening for receiving manually fed paper, cut paper sheets and continuous forms and an exit for delivery of printer manually fed paper, paper sheets and continuous forms from the housing, a cylindrical platen rotatably disposed in the housing, (b) (c) printing means disposed in the housing adjacent the periphery of the platen (d), a first paper feed path in the housing including a picker for delivering cut paper sheets to the platen at a first position therealong (e), a second paper feed path in the housing for delivering continuous forms to the platen at a second position therealong downstream from the first position, and (f) a third paper feed path in the housing for delivering manually fed paper to the platen at a third position upstream from the first position.

The present invention is further generally characterized in a printer with multiple paths including a cylindrical rotatable platen, matrix printing means disposed adjacent the platen, a bail mounted to be movable from a normal position engaging the platen downstream of the printing means to a displaced position spaced from the platen upstream of the printing means, a first paper feed path for supplying continuous forms to the platen at a position upstream of the printing means and downstream of the displaced position of the bail, and a second paper feed path for supplying paper to the platen for movement past the printing means via rotation of the platen.

Other objects and advantages of the present invention will become apparent from the following description of the preferred embodiment taken in conjunction with the accompanying drawings.

DESCRIPTION OF THE PREFERRED EMBODIMENT

Figure 1:
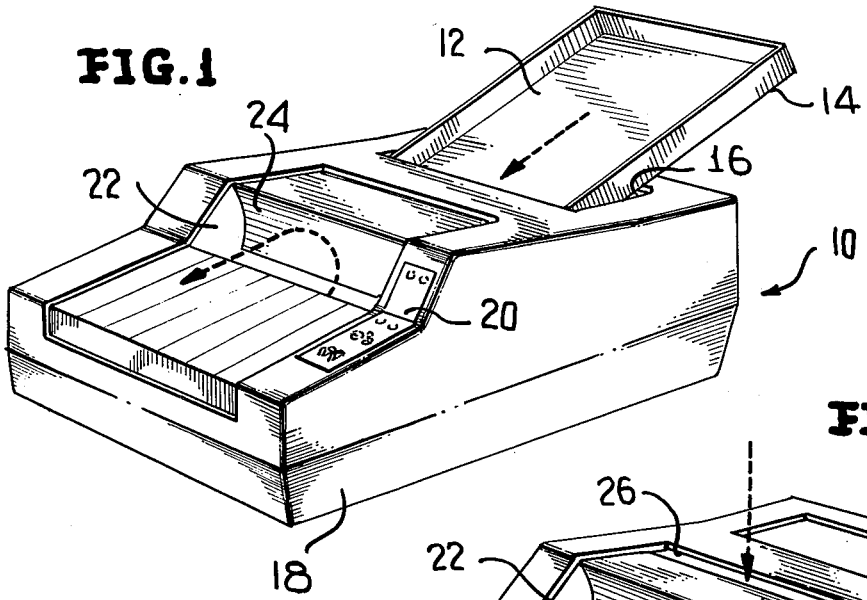
FIG. 1 is a perspective view of a high speed printer according to the present invention for use with cut paper sheets.
Figure 2:
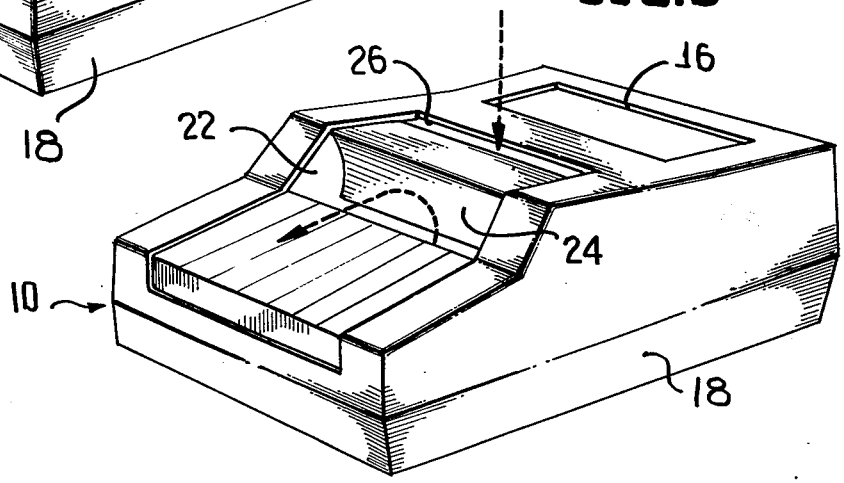
FIG. 2 is a perspective view of the high speed printer of the present invention for use with manually fed paper.
Figure 3:
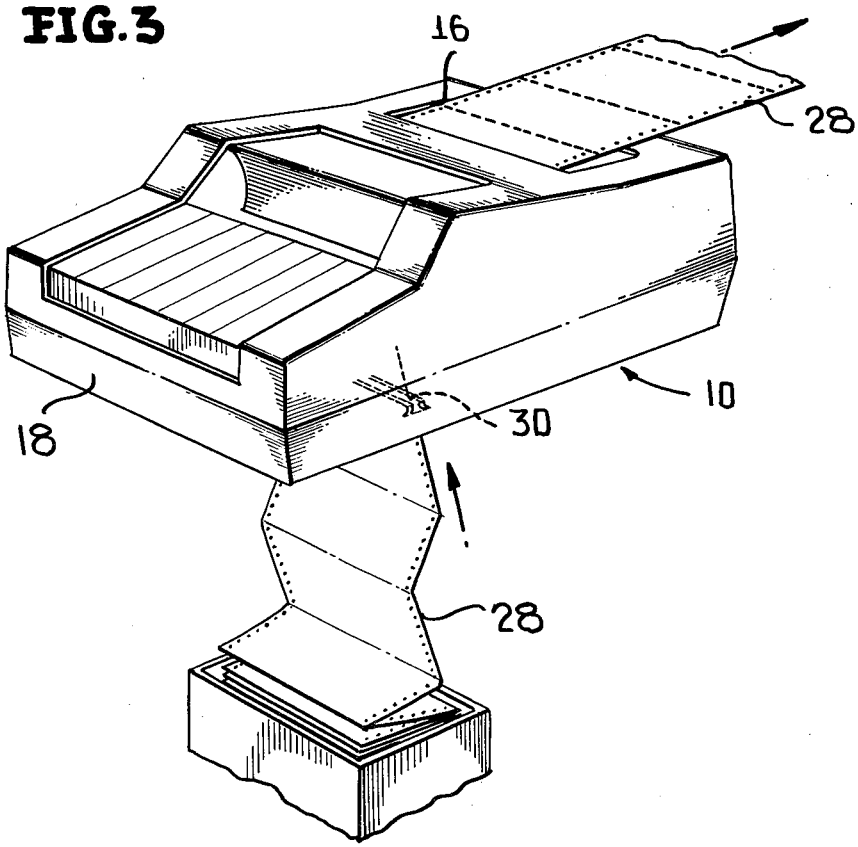
FIG. 3 is a perspective view of the high speed printer of the present invention for use with continuous forms.

A high speed printer 10 with multiple paper paths for printing on paper of various types and sizes is illustrated in FIGS. 1, 2 and 3 with the printer 10 illustrated in FIG. 1 receiving cut paper sheets 12 in a cassette 14 disposed in an opening 16 in the top of a housing 18 of a size to be supported on a desk or table top. A control panel 20 is mounted on the right side of the housing 18 to permit control of the printer by an operator. An exit opening 22 is disposed at the front of the housing adjacent a curved deflector 24 for stripping paper from the platen for exit via opening 22.

As illustrated in FIG. 2, the housing 18 has an opening 26 in the top thereof for receiving manually fed paper to be supplied to the platen, it being appreciated that the term "manually fed paper" is meant to include sheets of paper of varying sizes as well as continuous roll paper initially fed through the opening 26. The manually fed paper exits the housing through opening 22 in the same manner as the cut paper sheets illustrated in FIG. 1.

In FIG. 3, the printer 10 is illustrated for use with continuous forms 28 supplied to the printer via an opening 30 in the bottom of the housing 18 and the continuous forms 28 exit the housing via the opening 16 after printing.

Figure 4:
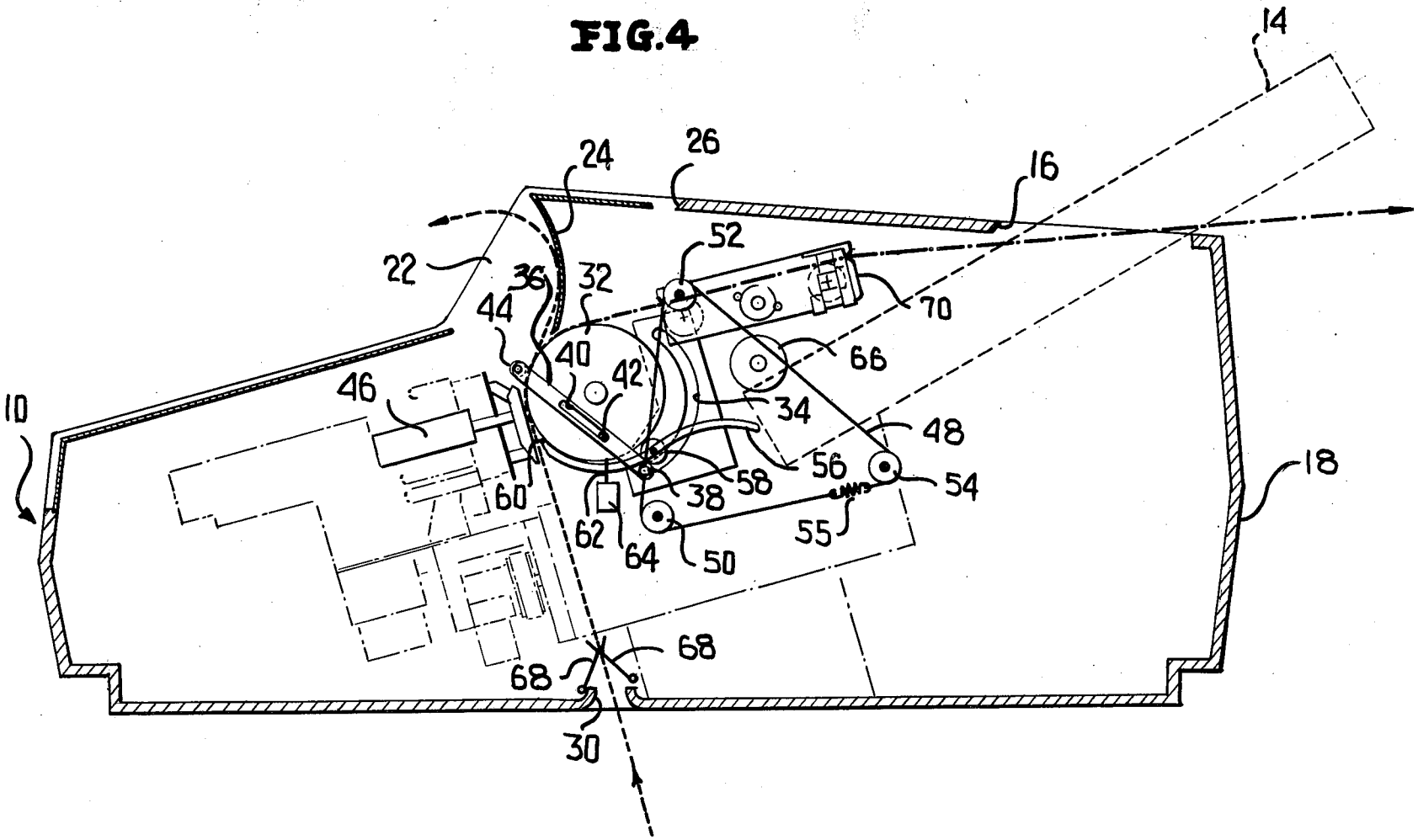
FIG. 4 is a sectional view of the high speed printer of the present invention.

Within the housing 18, as illustrated in FIG. 4, is a cylindrical platen 32 rotatably mounted at a position below opening 26 in the top of the housing and above opening 30 in the bottom of the housing. The platen is journaled in side plates disposed on opposite sides of the housing 18; and, in each side plate, is milled an arcuate cam groove 34 spaced from the periphery of the platen. A bail mechanism for the printer includes a pair of bail arms 36 each extending on an opposite end of the platen, and each bail arm 36 carries a pin 38 at the end thereof riding in one of the grooves 34. Slots 40 are formed in the centers of arms 36 and receive shoulder screws 42 extending from the side plates such that the bail arms 36 pivot about the shoulder screws 42. A bail roller 44 is journaled in the opposite ends of the arms 36 and, in a normal position, engages the platen downstream of a matrix printing mechanism 46 of conventional structure. The pins 38 are secured to wires 48 extending around idler pulleys 50 and 52 and each fastened to a drive pulley 54 driven by an electric motor, not shown, such that operation of the motor moves the wires to cause the pins 38 to ride along the grooves 34 and control position of the bail roller 44 as the bail arms 36 pivot about screws 42. A spring 55 is connected with the wires 48 to tension the wires about the pulley. A curved plate 56 guides cut paper sheets from cassette 14 and in conjunction with curved guide 100 guides manually fed paper into idler rollers 58 engaging platen 32. Idler rollers 58 are independently mounted and adjusted to platen 32 on square shaft 101. Flat springs 102 mounted to shaft 103 extend through gaps in plate 56 and contact the platen at a position just upstream of the printing mechanism 46 to provide a point contact such that movement of the platen drives paper therealong after the paper passes the idler roller 58. A sensor 62 is disposed between the plate end 60 and the idler roller 58 to sense paper passing thereby and actuate a switch enabling electronics (not shown) to control the platen and the bail mechanism.

When a cassette 14 of cut paper sheets is disposed in opening 16, the end will be positioned beneath a picker roller 66 which moves the top sheet from the stack of cut paper sheets from the cassette, when operated, to deliver the sheet to the platen 32 at a position to be moved therearound via contact of the platen with idler roller 58. Clutch 104 in picker roller 66 allows platen 32 to advance paper from cassette 14 while picker roller 66 rotates freely. After the cut sheets are moved around the platen and printed, the cut sheets pass under bail roller 44 and are stripped from the platen via deflector 24 to exit the housing via opening 22. Manually fed sheets enter through opening 26 and are guided to idler roller 58 by guide 100 and are moved by the platen after passing by idler roller 58 in a similar fashion to exit at opening 22. Continuous forms enter the housing via opening 30 in the bottom thereof and are held in tension by spring fingers 68, the continuous forms being supplied to the platen downstream of the end 60 of plate 56 and moving around the platen under the action of a tractor mechanism 70 to exit the housing 18 via opening 16.

The operation of the high speed printer 10 will be described in more detail with respect to FIGS. 5, 6 and 7 which illustrate the paths of travel of cut paper sheets, manually fed paper, and continuous forms, respectively.

Figure 5:
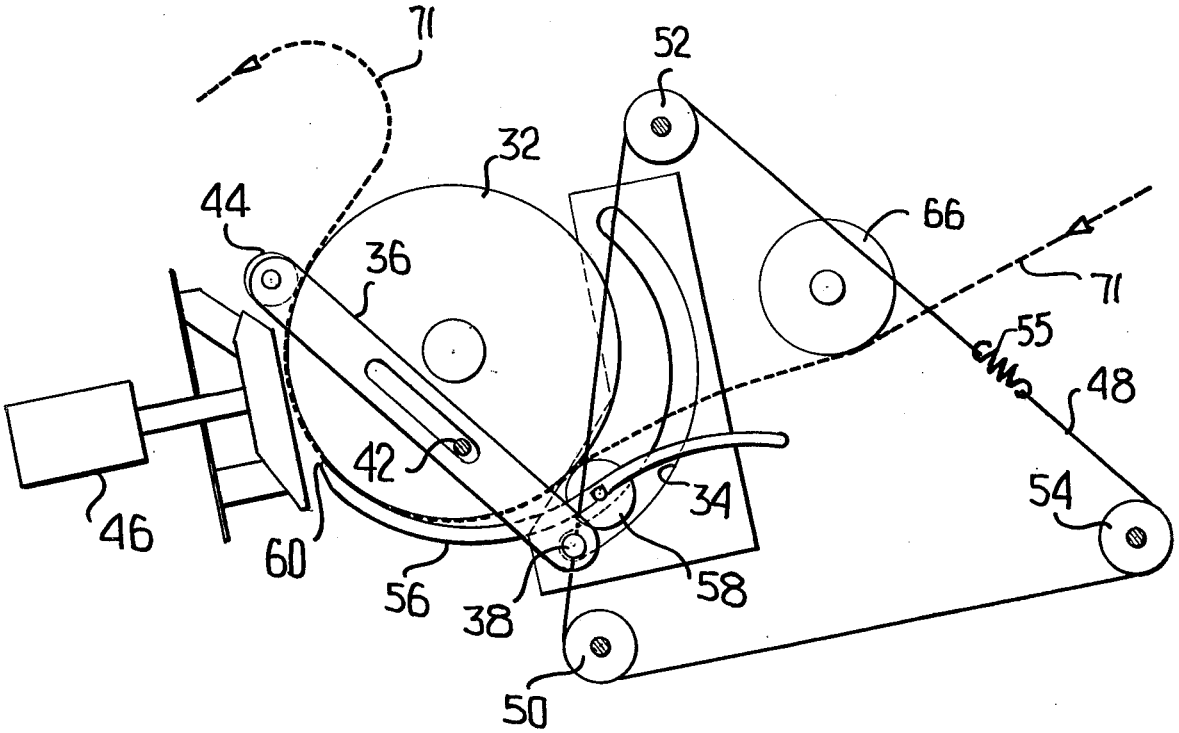
FIG. 5 is a diagramatic view of the high speed printer of the present invention receiving cut paper sheets.
Figure 7:
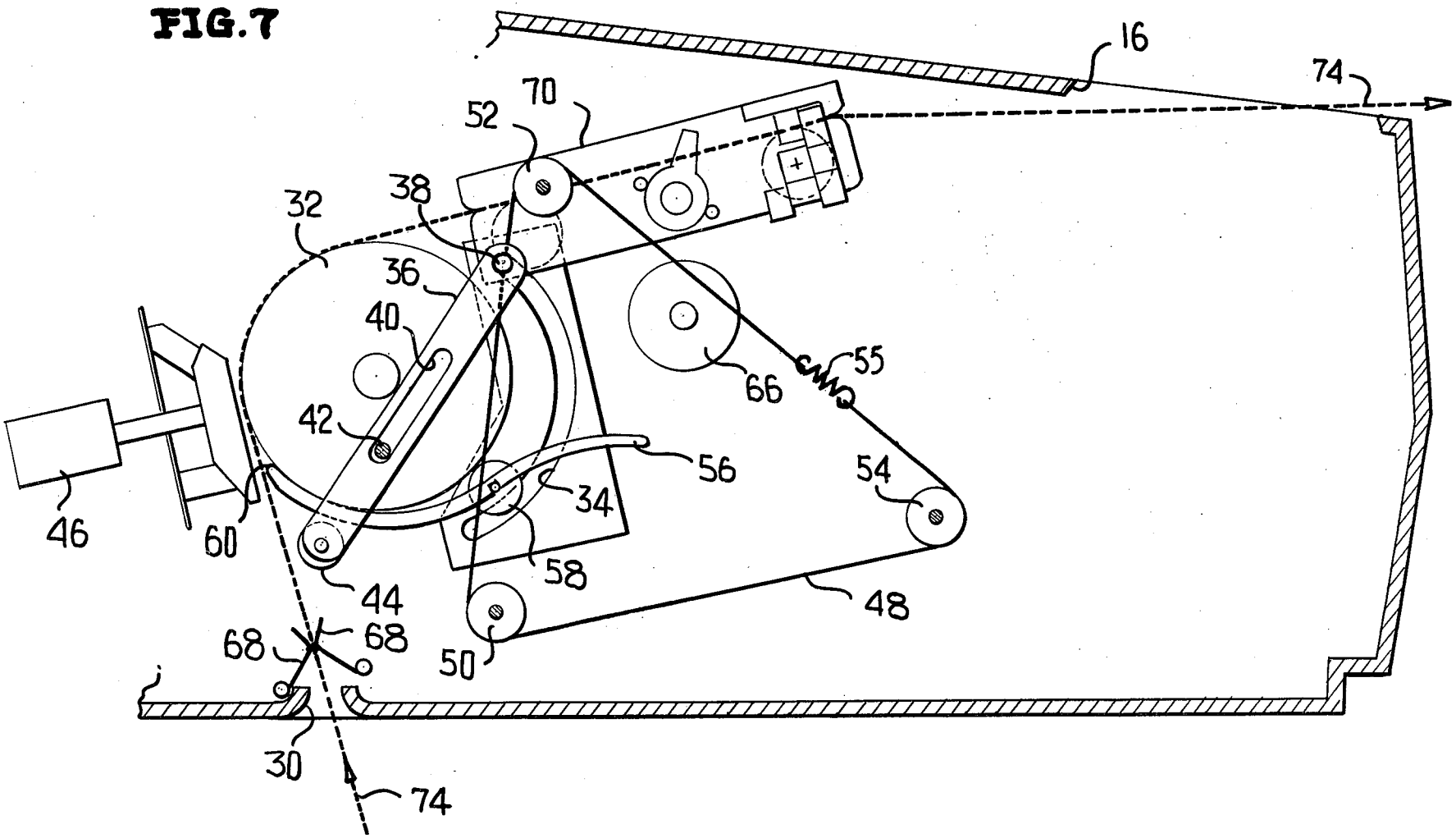
FIG. 7 is a diagramatic view of the high speed printer of the present invention receiving continuous forms.

With respect to cut paper sheets, as illustrated in FIG. 5, the bail 44 will be moved from its normal position in engagement with the platen 32 downstream of the printing mechanism 46 to the displaced position shown in FIG. 7 by operation of the drive pulley 54 to cause the wires to move the pin 38 upwards in groove 34 thereby causing the bail arm 36 to pivot, and move the bail roller 44 to a position upstream of the printing station and spaced from the platen 32. The cut paper sheets are picked from the top of the cassette 14 by picker roller 66 and supplied to the platen at a position adjacent idler roller 58 such that the friction drive between the platen and the idler roller 58 and contact of flat spring 102 drive the cut paper sheets past the sensor 62 and the printing station, the sensor 62 operating the bail mechanism to return the bail roller 44 to the normal position to hold the cut sheet against the platen during printing. After printing, the cut sheet is stripped from the platen via the deflector 24 and exits the housing, as shown via dashed line 71, and the next sheet to be fed is forwarded by picker roller 66 with similar operation of the bail mechanism to position the cut sheet at the printing station with the bail roller displaced and then return the bail roller to its normal position. Conventional control circuitry can be utilized to control the operation of picker roller 66 and the bail mechanism such that, as each cut sheet is supplied by the picker roller to the platen, the pulley 54 will be operated to move the bail to the displaced position illustrated in FIG. 7, the pulley then being operated in the reverse direction to cause the bail to return from its displaced position to the normal position illustrated in FIG. 5 to capture each sheet to hold it against the platen during printing.

Figure 6:
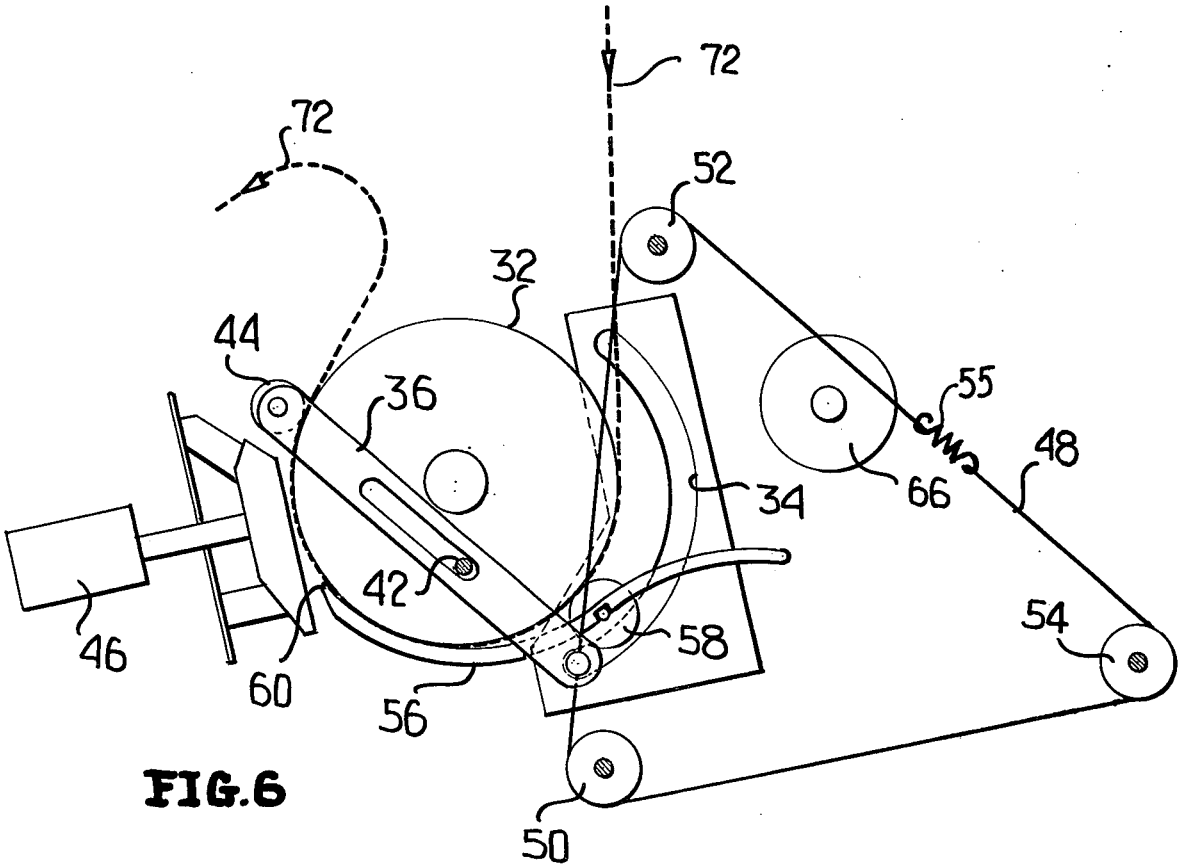
FIG. 6 is a diagramatic view of the high speed printer of the present invention receiving manually fed paper.

When paper is manually fed through the top opening 26 of the housing, it is supplied to the platen via guide 100 at a position upstream of the posiiton at which the cut paper sheets are supplied to the platen, as illustrated in FIG. 6 via the dashed line 72; and, once passing idler roller 58, the manually fed paper continues past the printing station in the same manner as the cut paper sheets to be stripped from the platen by the deflector to exit the housing with similar operation of the bail mechanism. During the manual feed operation, the bail can be controlled via the control panel 20 to be moved to its displaced position and then return to its normal position once the manually fed paper has been driven around the platen as well as being automatically operated via sensor 62.

When continuous forms are to be used with the printer 10, the bail mechanism is operated to move the bail roller to the displaced position shown in FIG. 7 so as not to interfere as the continuous forms enter via opening 30, as shown by dashed line 74, and contact the platen downstream of the position at which the cut paper sheets contact the platen, the continuous forms being moved around the platen and past the printing mechanism 46 via the tractor 70 prior to exit from the housing via opening 16.

From the above, it will be appreciated that the positioning of the paper feed paths for the cut paper sheets, manually fed paper and continuous forms about the cylindrical platen 32 coupled with the movement of the bail roller 44 permits either of the three paper feed paths to be utilized to allow printing on any type or size paper.

Inasmuch as the present invention is subject to many variations, modifications and changes in detail, it is intended that all subject matter discussed above and shown in the accompanying drawings be interpreted as illustrative and not in a limiting sense.

What is claimed is:

1. A printer with multiple paper paths comprising:

a cylindrical rotatable platen;

a printing element disposed adjacent said platen;

a bail mechanism having paper engaging members moveable from a normal position engaging said platen downstream of said printing element to a displaced position spaced from said platen upstream of said printing element;

first paper feed means for supplying continuous forms to said platen along a first path at a position upstream of said printing element and downstream of said displaced position of said bail mechanism;

second paper feed means for supplying paper to said platen along a second path for movement of the paper past said printing element by rotation of said platen, and control means for (a) moving said paper engaging members to said normal position when paper fed by said second paper feed means is presented to said printing element; and (b) positioning said paper engaging means at said displaced position when paper is fed by said first paper feed means.

2. A printer as recited in claim 1 and further comprising a flat springs having an ends contacting said platen to provide friction drive of paper by rotation of said platen.

3. A printer according to claim 2 further comprising:

a motor rotating said platen when said paper engaging members are in said normal position thereby to advance paper supplied by said second paper feed means through said printer.

4. A printer as recited in claim 2 wherein said second paper feed means supplies paper to said platen at a position upstream of said position at which said first paper feed means supplies continuous forms to said platen.

5. A printer as recited in claim 4 and further comprising third paper feed means for supplying manually fed paper to said platen along a third path at a position upstream of said position at which said second paper feed means supplies paper to said platen.

6. A printer as recited in claim 1 wherein said control means includes a member having curved cam groove therein, a pivotally mounted arm carrying a bail roller, a cam follower riding in said cam groove, and motor means for moving said cam follower in said cam groove to move said bail mechanism.

7. A printer for selectively printing on a continuous paper length or on a single sheet of paper with a printing mechanism, the printer comprising:

a cylindrical platen which rotates about the longitudinal axis thereof to carry paper past the printing mechanism in a single direction in proceeding from one printing line to a successive printing line;

first means for guiding a continuous paper length along a path directly to the platen at a location upstream from the printing mechanism relative to paper travel about said platen;

tractor means, downstream from the printing mechanism and positioned relative to said platen along the direction of paper travel, for pulling the continuous paper length in synchrony with the rotation of said platen;

second means for feeding one sheet from a stack of sheets of paper along a path from said stack to said platen to be carried by said platen past the printing mechanism, said second means being upstream from the intersection of the path of said continuous paper length and said platen;

a bail mechanism including a bail roller movable between (a) a first angular position upsgream from said intersection, and (b) a second angular position downstream from the printing mechanism;

control means for (a) positioning the bail roller at the first position when said first means is guiding a continuous paper length to be carried about the platen, and (b) moving the bail roller from the first position to the second position to capture a single sheet as it is being fed and to hold the fed single sheet against the platen downstream from the printing mechanism during printing.

8. A printer as recited in claim 7, wherein the second means includes picker roller means for delivering the top single sheet from the stack of single sheets to be carried by said platen past the printing mechanism.

9. A printer as recited in claim 8, further comprising:

third means for sensing when each single sheet from the stack of sheets is being supplied;

the control means moving the bail roller (a) from the second position to the first position as each successive sheet from the stack is sensed and (b) from the first position to the second position when each successive fed sheet exits the printer.

10. A printer as recited in claim 9 further comprising:

fourth means for guiding a separate single sheet to said platen, said fourth means being upstream of the second means.

11. A printer as recited in claim 9 further comprising a housing which encloses at least said platen, said housing including deflector means for directing each single sheet forward of the platen after the sheet passes the bail roller in the second position.

12. A printer as recited in claim 11 wherein the housing has a top surface with a first opening therein rearward of said platen, a cassette which contains the stack of sheets, the cassette being insertable into the first opening.

13. A printer as recited in claim 12 wherein said housing includes a second opening in the top surface of said housing to receive manually fed paper for supply to a third paper feed means.

14. A printer according to claim 13 wherein said third paper feed means defines a paper feed path commencing upstream of the path defined by said second paper feed means.

15. A printer as recited in claim 12 wherein the tractor means is disposed to direct the continuous paper length through the first opening.

16. A printer as claimed in claim 7 further comprising two end plates at each end of said platen, each end plate having (a) one end of said platen journalled therein, (b) an arcuate groove therein, (c) a screw extending toward the platen end;

the bail mechanism including (a) a bail roller extending longitudinally beyond the ends of said platen and (b) at each end of the bail roller an arm having (i) a first end into which one end of said bail roller is journalled, (ii) a slot along the length thereof, and (iii) a cam follower at the second end of the arm to travel along the arcuate groove of one corresponding end plate, the screw of said one corresponding end plate travelling along the slot in the arm;

the slots and the grooves being oriented and dimensioned so that movement of the second end of each arm along the corresponding arcuate groove thereof results in said bail roller moving substantially circumferentially between a first position upstream of the printing element and a second position downstream therefrom.

* * * * *